US005847473A

United States Patent [19]

Anfosso et al.

[11] Patent Number: 5,847,473

[45] Date of Patent: Dec. 8, 1998

[54] ELECTRICAL CONTACTOR HAVING A DOUBLE IMMERSION SENSING FUNCTION

[75] Inventors: Roger Anfosso, Sanary Sur Mer; Franck Garde, La Garde, both of France

[73] Assignee: Pyromeca S.A., Toulon, France

[21] Appl. No.: 913,249

[22] PCT Filed: Mar. 5, 1996

[86] PCT No.: PCT/FR96/00341

§ 371 Date: Sep. 10, 1997

§ 102(e) Date: Sep. 10, 1997

[87] PCT Pub. No.: WO96/28834

PCT Pub. Date: Sep. 19, 1996

[30] Foreign Application Priority Data

Mar. 10, 1995 [FR] France ..... 95 03076

[51] Int. Cl.[6] ..... H01H 35/18

[52] U.S. Cl. ..... 307/118; 441/93; 441/94; 222/5

[58] Field of Search ..... 307/118; 361/178; 222/5; 441/92, 93, 94, 95

[56] References Cited

U.S. PATENT DOCUMENTS 3,739,673 6/1973 Temple .

FOREIGN PATENT DOCUMENTS 174 891 3/1986 European Pat. Off. .
1288400 9/1972 United Kingdom .

*Primary Examiner*—Jeffrey A. Gaffin
*Assistant Examiner*—Peter Zura
*Attorney, Agent, or Firm*—Pillsbury Madison & Sutro LLP

[57] ABSTRACT

An electrical switch having a double liquid medium immersion sensing function is disclosed. The switch (121) particularly includes a battery (125) connected to a power outlet (126) via an electronic circuit (124) that only connects the battery to the outlet once a first pair of electrodes (131, 132) have sensed immersion in a predetermined medium, and a second pair of electrodes (133, 134) connected to a pressure sensor (135) have sensed a predetermined immersion depth. Said switch (121) is advantageously connected to a pyrotechnic device (75) for inflating emergency equipment such as life jackets.

25 Claims, 9 Drawing Sheets

ELECTRICAL CONTACTOR HAVING A DOUBLE IMMERSION SENSING FUNCTION

This application is the national phase of international application PCT/FR96/00341, filed Mar. 10, 1995 which designated the U.S.

The present invention relates to the field of the sensing of immersion in a liquid medium.

More specifically, the invention relates to an electrical contactor placed between an electrical power source and a receiver device, the contactor closing the electrical circuit only if it is immersed to a predetermined depth and for a predetermined period of time in a defined liquid medium. A preferred application of a contactor according to the invention is in the field of the inflation of life-jackets.

Electrical contactors for underwater work, such as for example the actuation of a pyrotechnic cable cutter, are already known, for example from U.S. Pat. No. 3,739,673. The contactor described in that patent comprises, in particular, a rigid cup which can move axially with respect to the body of the contactor under the effect of the pressure and thus bring two blades initially separated by a partially deformable spacer into contact with each other. Such contactors are entirely satisfactory for high-pressure fields and in particular for the pressures generated by an underwater explosion. However, such contactors are not reliable under shallow-immersion conditions, in particular because of the rubbing of the seal positioned between the moveable cup and the rest of the body of the contactor.

Contactors have therefore been sought which operate under shallow-immersion conditions and therefore under a small change in pressure with respect to atmospheric pressure. Such a contactor has, for example, been proposed in Patent FR-B-2,569,305 or in its corresponding Patent EP-B-0,174,891. According to this solution, the contactor does not form an independent element but is integrated into a pyrotechnic device. Actuation of the electrical circuit is not due to the mechanical deformation of a component but is caused by a sudden change in conductance associated with the ingress of the liquid into the electrical casing through a very low-porosity membrane set to allow the liquid to pass through only for continuous immersion.

Although such a contactor is, in theory, perfectly reliable, in practice its operation depends on its position at the moment of immersion and it is not totally reliable.

For various applications such as, for example, the inflation of life-jackets, those skilled in the art are therefore always searching for an electrical contactor having a very high operating reliability under shallow-immersion conditions.

The object of the present invention is specifically to provide such a contactor.

The invention therefore relates to an electrical contactor which can be actuated by immersion in a liquid medium and comprises a casing which includes a liquid-tight sealed compartment which contains an electronic circuit interposed between a DC power source and a power outlet, the said circuit comprising at least one connection component which connects the DC source to the outlet only if a sufficient voltage is applied to it, the said compartment having an immersion-sensitive wall with an external face which is in direct contact with the liquid in which the contactor is immersed, characterized in that:

i) the said electronic circuit includes a first pair of electrodes, the free ends of which lie on the external face of the immersion wall and which thus constitute a variable resistor whose resistance depends on the nature of the medium with which the said wall is in contact;

ii) the said electronic circuit includes a second pair of electrodes, the free ends of which are connected to an element which is sensitive to the pressure applied to it and at least part of which lies on the external face of the said immersion wall so as to make the said electrodes sensitive to the pressure of the medium with which the said wall is in contact;

iii) the said immersion-sensitive wall includes an aperture closed by a microporous membrane which is permeable to gases and impermeable to the said liquid medium;

iv) the said electronic circuit delivers the sufficient voltage to the said connection component only if each pair of electrodes has identified an occurrence of a threshold, predetermined in respect of its operating parameters, being crossed.

Thus, when the power outlet is connected to a receiving device, the contactor according to the invention will close the electrical circuit only when two conditions are simultaneously met:

the contactor must be immersed so that the variable resistor constituting the first pair of electrodes falls below its operating threshold, the contactor must be subjected to a pressure sufficient for the second pair of electrodes connected to the pressure-sensitive element to detect, when it is operating, that a threshold has been crossed.

Unlike the contactor forming the subject of Patent FR-B-2,569,305, the contactor according to the invention is perfectly reliable in all positions since all that is required is for the liquid medium to cover the external face of the immersion-sensitive wall without having to enter the contactor proper. This is because the microporous membrane is impermeable to the liquids and has the sole function of maintaining, before operation, the ambient atmospheric pressure in the sealed compartment.

According to a first preferred embodiment variant of the invention, the connection component is chosen from the group consisting of semiconductors and relays.

According to a second preferred variant, the said pressure-sensitive element includes an internal free volume which communicates with the inside of the sealed compartment, thereby making it possible to guarantee, before operation, that the said element is always set to the ambient atmospheric pressure and can thus be sensitive to very small changes in pressure, i.e. at very shallow immersion depths.

To this end, the said microporous membrane will advantageously be chosen from the group consisting of hydrophobic membranes and oleophobic membranes, depending on the type of liquid medium intended to receive the contactor, and more preferably the said membrane will include at least one layer of fibrous material made of expanded polytetrafluoroethylene.

According to a third preferred variant, the said casing includes a sealed housing for the DC source which will advantageously consist of an electric cell.

According to a fourth preferred variant, the said immersion-sensitive wall will be protected by an outer cover provided with apertures allowing a liquid to come into contact with the said wall.

Advantageously, these apertures will be side apertures enabling the said cover to provide complete frontal protection of the said immersion-sensitive wall.

According to a first preferred embodiment of the invention, the contactor is characterized in that:

the free ends of the second pair of electrodes are connected to a force-sensitive resistor arranged on the external face of the said immersion wall so as thus to constitute a variable resistor whose resistance depends on the pressure of the medium with which the said wall is in contact;

and in that the said electronic circuit delivers the sufficient voltage to the said connection component only if the resistance of each of the two variable resistors becomes less than a predetermined specific threshold resistance.

In this embodiment of the invention, the connection component advantageously consists of a transistor.

According to a preferred variant, the said electronic circuit comprises two independent potent-iometric divider bridges connected to the said connection component and each including an input comparator and an output comparator which are separated by a diode, each bridge containing one of the two variable resistors which is associated with its threshold resistance.

Advantageously, each divider bridge will consist of a double power operational amplifier and preferably the two bridges will be grouped together into a single quadruple power operational amplifier.

According to another preferred variant, the two divider bridges are connected to an integrator which turns on the output comparators only if the two variable resistors have fallen below their respective values for a predetermined period of time.

With this first embodiment of the invention, it is thus possible to add, in the case of closing the electronic circuit, a third condition relating to the period of immersion.

Preferably, the said integrator will consist of a resistor and a capacitor.

As already indicated above, the said force-sensitive resistor advantageously includes an internal free volume which communicates with the inside of the sealed compartment.

According to a second preferred embodiment of the invention, the contactor is characterized in that:

the free ends of the second pair of electrodes are connected to a pressure sensor, the sensitive part of which lies on the external face of the immersion-sensitive wall, which pressure sensor mainly consists of two Wheatstone bridges which are connected to the said electronic circuit and can be modulated as a function of the pressure exerted on the said sensitive part so as to generate, between the said electrodes, a voltage Tp which varies as a function of the pressure of the medium with which the said wall is in contact;

and in that the said electronic circuit delivers the sufficient voltage to the said connection component only if the first pair of electrodes has identified an electrical resistance Re less than a predetermined threshold and if the second pair of electrodes has identified a voltage Tp greater than a predetermined threshold.

In this second preferred embodiment of the invention, the connection component is advantageously a thyristor.

According to a preferred variant, the said electronic circuit thus comprises four separate modules connected to the said connection component: a power control, an oscillator, a signal detector and a microphonic amplifier, it being possible for the oscillator, the signal detector and the microphonic amplifier to be supplied with voltage only if the electrical resistance appearing across the first pair of electrodes has reached its threshold level.

Advantageously, the said pairs of electrodes are therefore not located in the same module so as to make the energization of the module which includes the said second pair of electrodes dependant on the module which incorporates the said first pair of electrodes, namely the power control.

Preferably, the power control module, placed between the DC source and the power outlet, is connected as input to the first pair of electrodes and as output to the signal detector, so as to actuate the energization of the other three modules. The power control module therefore acts as a switch for the other three modules of the electronic circuit.

The oscillator module, preferably consisting of an operational amplifier, is connected as input to the microphonic amplifier and as output to the pressure sensor, so as to supply the said pressure sensor with AC current.

The signal detector module, preferably consisting of an operational amplifier, is connected as input to the power control and as output to the microphonic amplifier so as to convert the amplified AC voltage from the said pressure sensor into a DC voltage.

The microphonic amplifier module, preferably consisting of an operational amplifier, is connected as input to the signal detector and as output to the oscillator, so as to detect an increasing AC voltage.

Preferably, the said operational amplifiers will be grouped together into a single quadruple operational amplifier.

According to another preferred variant, the said pressure sensor includes an internal free volume which communicates with the inside of the sealed compartment, thereby making it possible to guarantee, before operation, that the said pressure sensor is always set to the ambient atmospheric pressure and is thus able to be sensitive to very small changes in pressure, i.e. at very shallow immersion depths.

This second embodiment of the invention makes it possible to obtain contactors which can withstand salt fog particularly well.

The invention also relates to the use of an electrical contactor according to the invention by connecting the outlet to a receiver pyrotechnic device which has to be actuated in the event of immersion. One of the many particularly advantageous uses of the invention consists in connecting the contactor to a pyrotechnic device which can be used to inflate objects such as, for example:

life-jackets, detection balloons, anti-capsizing balloons, etc.

The pyrotechnic device may advantageously consist of a pyrotechnic perforator coupled to a pressurized-gas cartridge or else consist of a pyrotechnic gas generator.

One particularly advantageous use of the invention consists in connecting the contactor to a pyrotechnic life-jacket inflation device so as to provide lifejackets with a facility of being automatically inflated in the event of prolonged immersion of persons wearing them.

Two illustrative embodiments and an example of application of the contactors according to the invention are described hereinbelow with reference to FIGS. 1 to 11.

The structure and operation of the contactor shown in FIGS. 1 to 6 are now described in detail.

Figure 5:
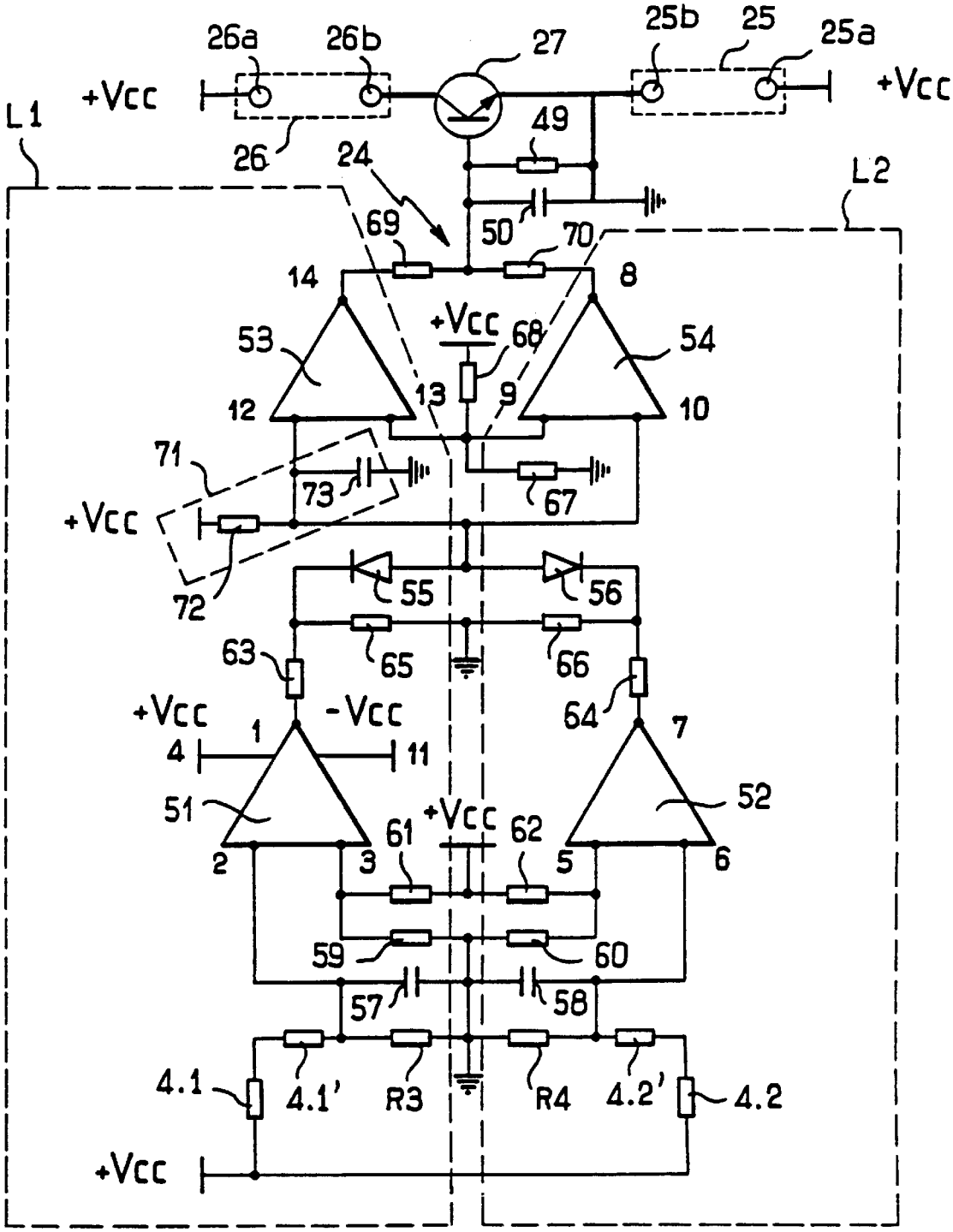
FIG. 5 is a functional diagram of the electronic circuit of the contactor shown in FIG. 1.

The invention relates in this first case to an electrical contactor 21 intended for sensing immersion in a liquid medium. This contactor 21 consists of a casing 22 which includes a liquid-tight sealed compartment 23. This compartment 23 contains an electronic circuit 24 interposed between a DC source 25 and a power outlet 26. The electronic circuit 24 comprises at least one connection component 27 which provides connection between the source 25 and the outlet 26 only if a sufficient voltage is applied to it by the rest of the electronic circuit, the detailed description of which will appear a little later in the description. This connection component is advantageously a transistor, as shown in FIG. 5.

Figure 1:
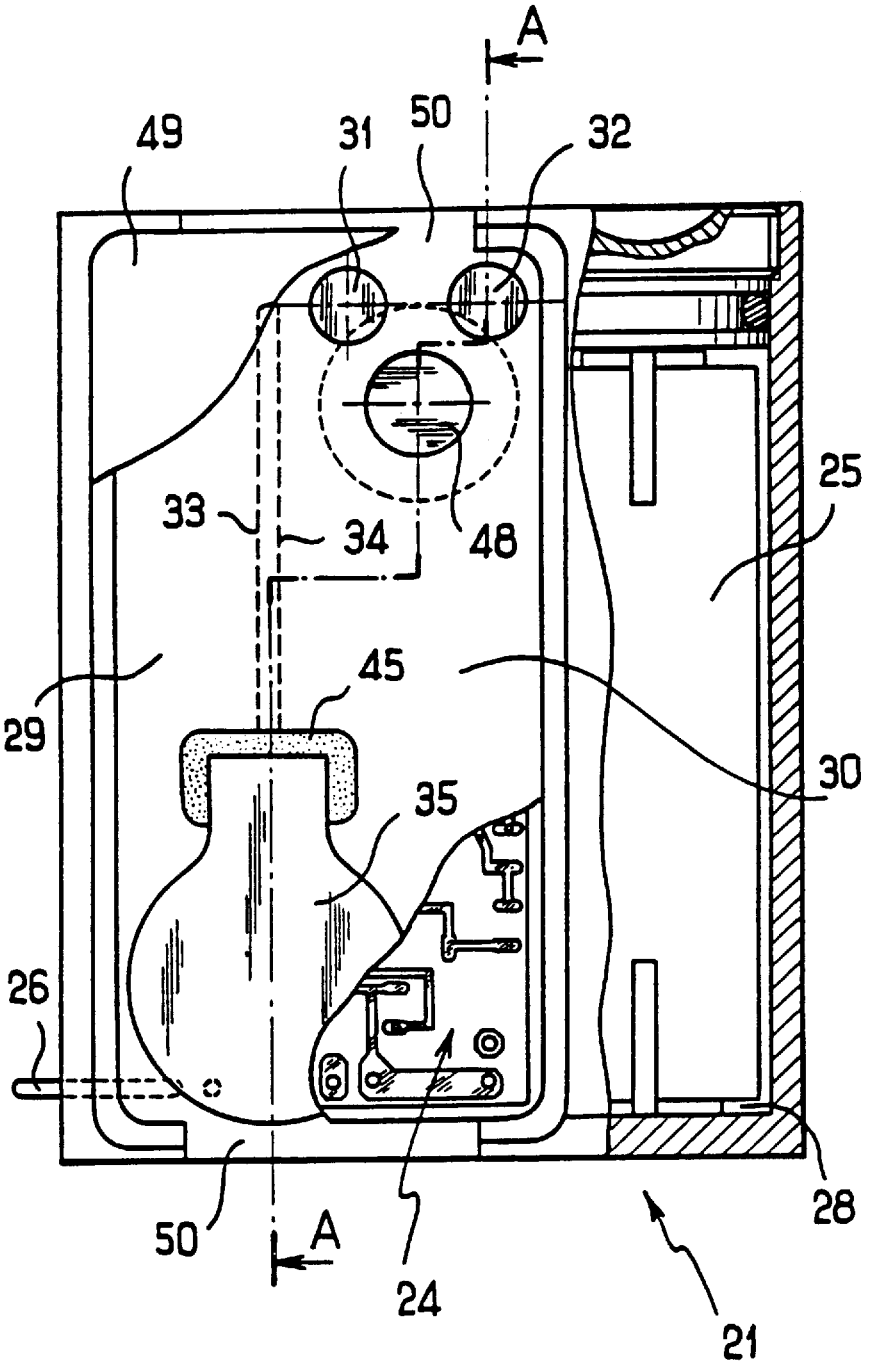
FIG. 1 is a view from above, with two partial cut-aways, of a contactor produced according to the first preferred embodiment of the invention.

As shown in FIG. 1, the casing 22 includes a sealed housing 28 for the DC source 25 which will advantageously consist of a 3.6-volt lithium battery for the applications intended for inflating life-jackets.

The said sealed compartment 23 has an immersion-sensitive wall 29, the external face 30 of which is in direct contact with the liquid in which the contactor 21 is immersed.

According to first characteristic of the invention, the said electronic circuit 24 includes a first pair of electrodes 31 and 32 which pass through the immersion-sensitive wall 29. Thus, the free end of each of these two electrodes lies on the external face 30 of the immersion wall 29 and the two electrodes 31 and 32 constitute a variable resistor $R_3$ whose resistance depends on the nature of the medium, either a gaseous or a liquid medium, with which the said wall is in contact.

According to a second characteristic of the invention, the electronic circuit 24 includes a second pair of electrodes 33 and 34, the ends of which are connected to a force-sensitive resistor 35 placed on the external face 30 of the said immersion wall 29 so as thereby to constitute a variable resistor $R_4$ whose resistance depends on the pressure acting on the said wall.

Figure 3:
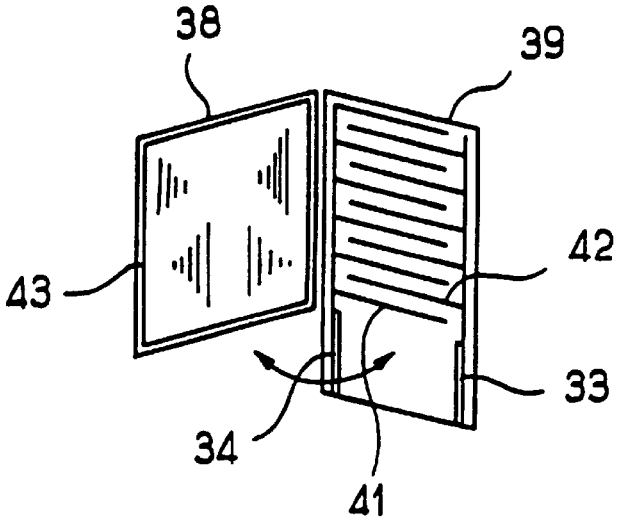
FIG. 3 is a diagrammatic view showing the principle of how a force-sensitive resistor is constructed.
Figure 4:
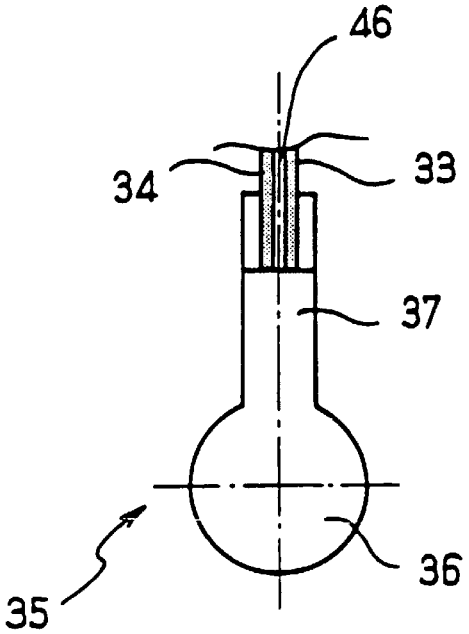
FIG. 4 is a partial view, from above, of a force-sensitive resistor used within the context of the present invention.

Referring more particularly to FIGS. 3 and 4, it may be seen that the force-sensitive resistor 35 is composed of a head 36 extended by a tail 37 containing the electrodes 33 and 34.

The head 36 includes a combination of two polymer sheets 38 and 39 laminated and joined together so as to leave between them, at rest, an internal free volume 40.

An array of conducting tracks 41 and 42 coming from the electrodes 33 and 34 is placed on the sheet 39, these tracks being interpenetrating without mutual contact.

A layer 43 of semiconducting polymer is deposited on the sheet 38. When a force is exerted on the outer surfaces of the sheets 38 and 39, these are flattened against each other and the polymer 43 establishes an electrical contact between the tracks 41 and 42. The head 36 of the resistor 35 rests on the outer face 30 of the immersion-sensitive wall 29 while the tail 37 penetrates, via an aperture 44 sealed off by a seal 45, the sealed compartment 23 so as to lead the electrodes 33 and 34 to the electronic circuit 24.

In order to guarantee good sensitivity of the force-sensitive resistor 35 to small changes in pressure, the tail 37 includes a hollow channel 46 which brings the free volume 40 into communication with the inside of the sealed compartment 23.

Such force-sensitive resistors are sold by the company Interlink under the trademark FSR®.

According to a third characteristic of the invention, the immersion-sensitive wall 29 includes an aperture 47 closed by a microporous membrane 48 which is permeable to gases and impermeable to the said liquid medium. Thus, it is guaranteed that, before operation, the pressure prevailing in the sealed compartment 23 and in the free volume 40 of the resistor 35 is always equal to the ambient atmospheric pressure, thereby enabling the resistor 35 to be sensitive to very small increases in pressure with respect to the said ambient atmospheric pressure. Preferably, the said microporous membrane 48 is chosen from the group consisting of hydrophobic membranes and oleophobic membranes.

More advantageously, the said microporous membrane 48 will include at least one layer of fibrous material made of expanded polytetrafluoroethylene.

Figure 2:
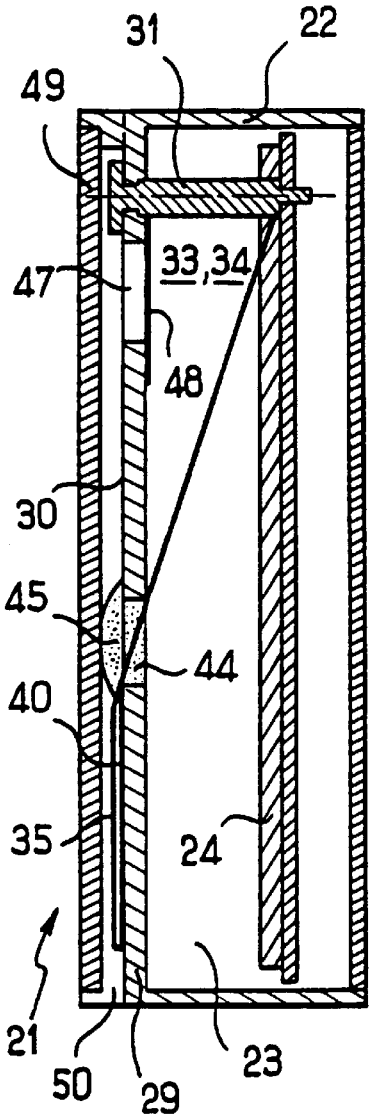
FIG. 2 is a section on A—A of the contactor shown in FIG. 1.

Thus constituted, the said immersion-sensitive wall 29 may form an outer face of the contactor 21; but according to a preferred embodiment of the invention, the immersion-sensitive wall 29 will be protected by an outer cover 49 provided with apertures 50 allowing a liquid to come into contact with the said wall. As shown in FIGS. 1 and 2, the apertures 50 will advantageously be side apertures so that the cover 49 can provide complete front protection of the wall 29.

According to a fourth characteristic of the invention, the electronic circuit 24 delivers a voltage to the said connection component 27, which is high enough to "switch it on" only if the resistance of each of the two variable resistors $R_3$ and $R_4$ becomes less than a predetermined specific threshold resistance. This double condition means that both the resistance across the electrodes 31 and 32 is sufficiently lowered by immersion of these electrodes in a predetermined liquid medium and the resistance across the electrodes 33 and 34 is also sufficiently lowered due to the effect of an increase in the pressure exerted on the resistor 35 in order to become less than a predetermined value.

The specific embodiment of this fourth characteristic will now be described, referring more particularly to FIGS. 5 and 6.

FIG. 5 shows the DC source 25, which has a positive terminal 25*a* and a negative terminal 25*b*, and the power outlet 26, which has a positive terminal 26*a* and a negative terminal 26*b*. The positive terminal 26*a* of the outlet 26 is connected directly to the positive terminal 25*a* of the source 25, while the negative terminal 26*b* of the outlet 26 is connected to the negative terminal 25*b* of the source 25 via a transistor 27, the third terminal of which is connected to the electronic circuit 24 supplied with DC via the source 25, according to the information depicted in FIG. 5.

The transistor 27 is protected against overvoltages by a resistor 49 and by a capacitor 50, both connected to earth.

The electronic circuit 24 comprises two independent potentiometric divider bridges L1 and L2, fictitiously isolated in FIG. 5 by dotted-line perimeters. These bridges are connected to the transistor 27 and each of them has an input comparator 51 or 52 and an output comparator 53 or 54 separated by a diode 55 or 56.

Each bridge contains one of the two variable resistors $R_3$ and $R_4$, the resistor $R_3$ being associated with its specific threshold resistance constituted by the resistors 4.1 and 4.1' and the resistor R4 being associated with its specific threshold resistance constituted by the resistors 4.2 and 4.2'.

Two capacitors 57 and 58 and nine resistors 59, 60, 61, 62, 63, 64, 65, 66 and 67 complete the balancing of the two bridges. Three resistors 68, 69 and 70 protect the electronic circuit 24.

Each divider bridge L1 and L2 will advantageously consist of a double power operational amplifier or, even better, the two divider bridges L1 and L2 will be integrated into a quadruple power operational amplifier and will thus constitute only a single component of the circuit 24.

According to a preferred embodiment of the invention, the divider bridges L1 and L2 are connected to an integrator 71, fictitiously isolated in FIG. 5 by a dotted-line perimeter. The integrator 71 enables the output comparators 53 and 54 to be turned on only if the two variable resistors $R_3$ and $R_4$ have fallen below their respective threshold values for a predetermined period of time.

Advantageously, the integrator 71 will consist of a resistor 72 and a capacitor 73.

The operating logic of the contactor according to the invention will now be described, referring more particularly to the diagram shown in FIG. 6 in which:

Vn ($V_1$, $V_2$, $V_3$. . . ) represents the voltage at the terminal n (1, 2, 3. . . ) of the circuit 24, as shown in FIG. 5;

Vcc represents the voltage delivered by the source 25;

0 represents the initial off state;

1 represents the on state, after the comparators have been switched on.

When the contactor 21 is not immersed, the resistance of each of the resistors $R_3$ and $R_4$ is very high, or even infinite, and the voltages $V_2$ and $V_6$ at the terminals of the input comparators 51 and 52 are close to the reference voltage supplied by the source 25 while the voltages $V_3$ and $V_5$ are approximately equal to half this reference voltage.

Under these conditions, the voltages $V_1$ and $V_7$ across the terminals of the input comparators 51 and 52 and $V_{12}$ and $V_{10}$ across the terminals of the output comparators 53 and 54 are not high enough to turn on the diodes 55 and 56 and the voltages $V_{14}$ and $V_8$ delivered by the output comparators are not high enough to turn on the transistor 27. The outlet 26 can therefore deliver no current since the terminal 26*b* of the latter is not connected to the terminal 25*b* of the DC source 25.

When the contactor 21 is immersed at a sufficient depth, the resistance of the resistor $R_3$ becomes less than its threshold resistance, constituted by the resistors 4.1+$_4$', and the resistance of the resistor $R_4$ becomes less than its threshold value, constituted by the resistors 4.2+4.2'. Under these conditions, the voltage $V_6$ across the terminals of the input comparator 52 becomes less than the voltage $V_5$ while the voltage $V_2$ across the terminals of the input comparator 51 becomes less than the voltage $V_3$. The voltages $V_1$ and $V_7$, on the one hand, and, on the other hand, $V_{10}$ and $V_{12}$ then acquire values sufficient to turn on the diodes 55 and 56 provided that the integrator 71 has turned on the system. The voltages $V_{14}$ and $V_8$ delivered by the output comparators are then high enough to turn on the transistor 27, the terminal 26*b* of the outlet 26 is then connected to the terminal 25*b* of the source 25 and the outlet 26 can distribute the current.

Figure 6:
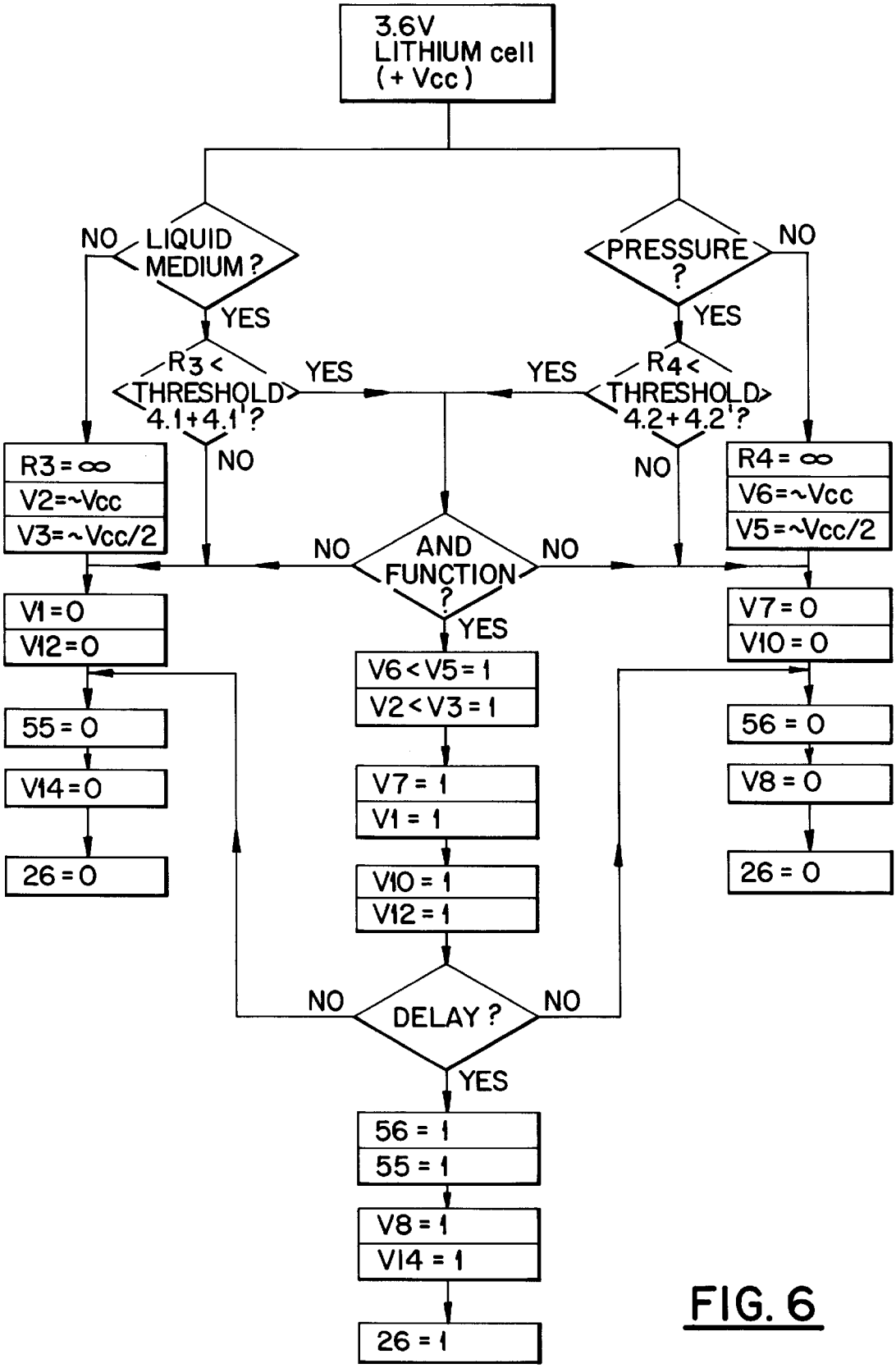
FIG. 6 is the logic flow diagram of the electronic circuit shown in FIG. 5.

The flow diagram given in FIG. 6 shows that if either of the conditions, relating to the presence of a liquid medium and to the existence of an overpressure with respect to the ambient atmospheric pressure, is not met, the contactor 21 will remain open since one of the diodes 55 or 56 will remain switched off. The same applies if the period of time necessary to operate the integrator 71 is not met, it being pointed out that, in the absence of an integrator, this period of time is zero and in this case the contactor responds immediately it is immersed to a certain depth.

The contactor according to the invention thus has many options in terms of adjusting the actuation thresholds:

i) by the choice of the values of the resistors 4.1 and 4.1' it is possible to determine the type of liquid medium capable of causing the contactor to operate; it is thus possible, for example, to distinguish immersion in sea water from immersion in fresh water.

ii) by the choice of the values of the resistors 4.2 and 4.2', it is possible to determine the minimum immersion depth capable of causing the contactor to operate.

iii) by the choice of the capacitor 73, it is possible to determine the minimum immersion period necessary to cause the contactor to operate.

The structure and operation of the contactor shown in FIGS. 7 to 10 will now be described.

Figure 9:
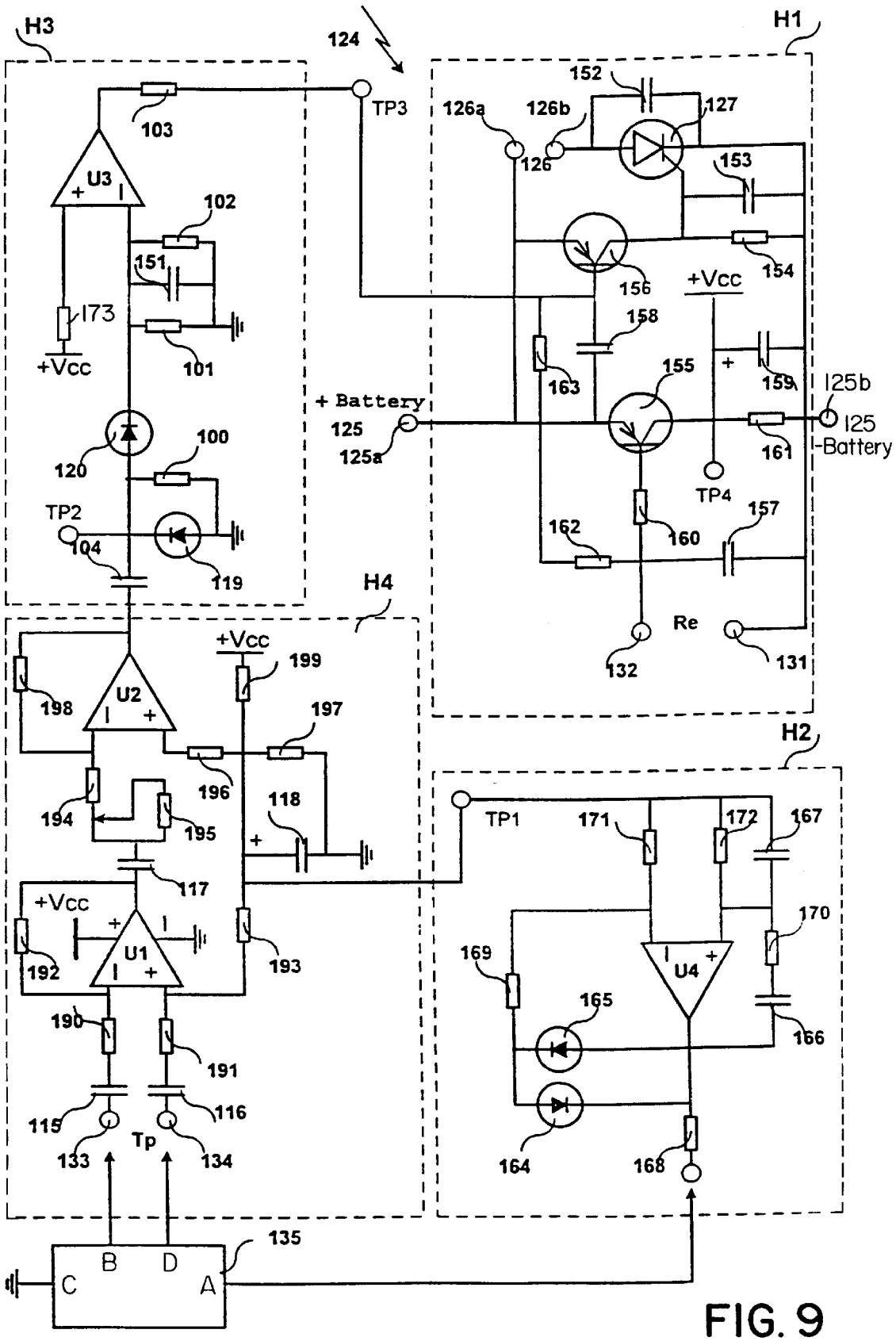
FIG. 9 is a functional diagram of the electronic circuit of the contactor shown in FIG. 7.

The invention relates in this second case to an electrical contactor 121 designed to sense immersion in a liquid medium. This contactor 121 consists of a casing 122 having a liquid-tight sealed compartment 123. This compartment 123 contains an electronic circuit 124 interposed between a DC supply source 125 and a power outlet 126. The said electronic circuit 124 comprises at least one connection component 127 which provides connection between the current source and the outlet 126 only if a high enough voltage is delivered to it by the rest of the electronic circuit 124, the detailed description of which will appear later in the description. This connection component is advantageously a thyristor, as shown in FIG. 9.

Figure 7:
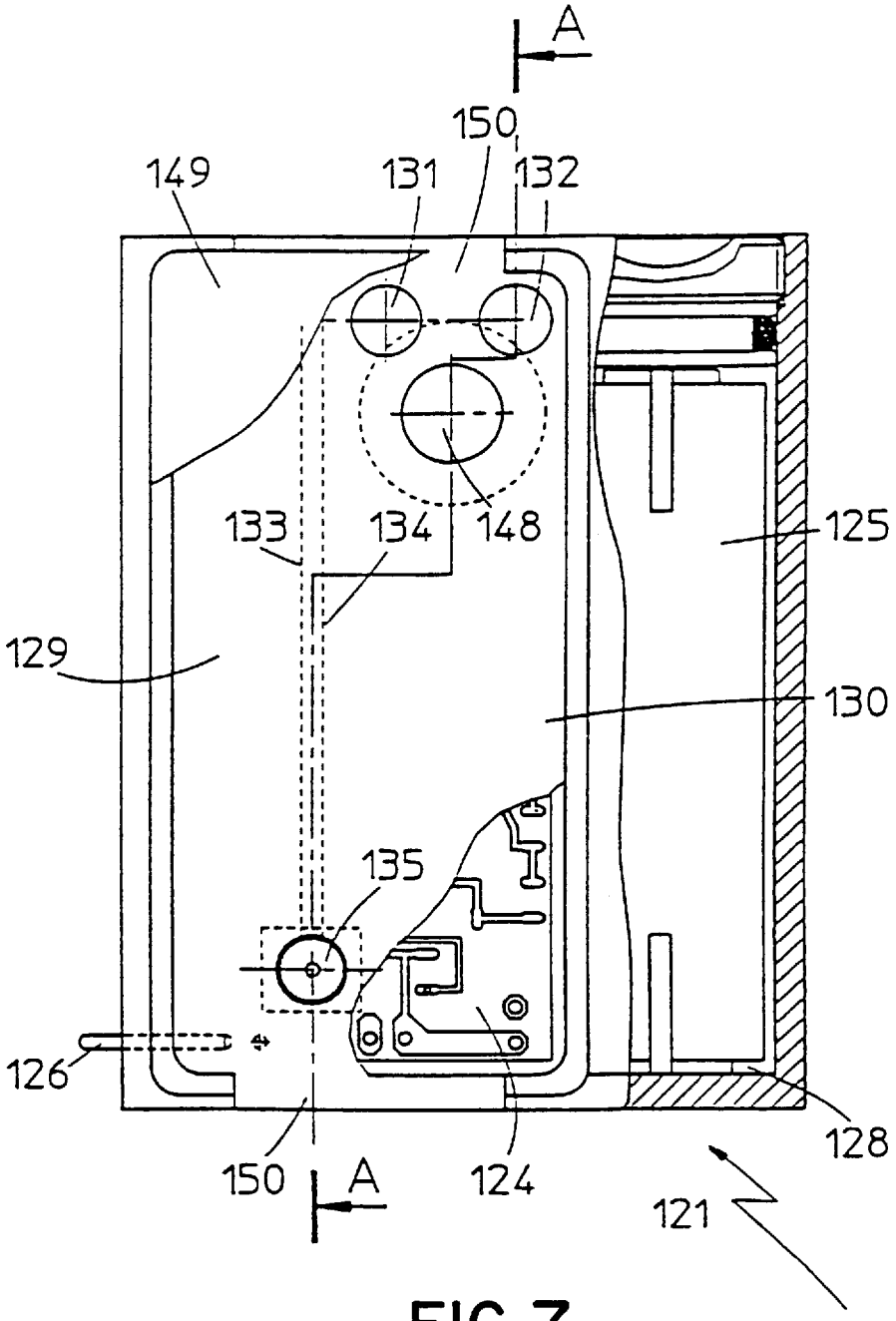
FIG. 7 is a view, from above with two cutaways, of a contactor produced according to the second preferred embodiment of the invention.

FIG. 7 shows that the casing 122 includes a sealed housing 128 for the DC source 125 which advantageously consists of a cell for applications relating to the inflation of inflatable reservoirs for the safety of goods or of persons.

The said sealed compartment has an immersion-sensitive wall 129, the outer face 130 of which is in direct contact with the liquid in which the contactor 121 is immersed.

According to a first characteristic of the invention, the said electronic circuit 124 has a first pair of electrodes 131 and 132 which pass through the immersion-sensitive wall 129. Thus, the free end of each of these two electrodes lies on the outer face 130 of the immersion-sensitive wall 129 and the two electrodes 131 and 132 constitute a variable resistance Re whose value depends on the nature of the medium, whether gaseous or liquid, with which the said immersion-sensitive wall 129 is in contact.

According to a second characteristic of the invention, the electronic circuit 124 has a second pair of electrodes 133 and 134 whose ends are connected to a pressure sensor 135, one of the ends of which, passing through an aperture 144 which is sealed off by a seal 145, lies on the outer face 130 of the immersion-sensitive wall 129 so as to generate a voltage Tp which varies depending on the pressure of the medium in which the said immersion-sensitive wall 129 is in contact. The sensor 135 has a free volume 140 which communicates with the inside of the compartment 123.

According to a third characteristic of the invention, the immersion-sensitive wall 129 has an aperture 147 closed by a microporous membrane 148 which is permeable to gases and impermeable to the said liquid medium. Thus, it is guaranteed that, before operation, the pressure existing in the sealed compartment 123 and in the free volume 140 of the pressure sensor 135 is always equal to the ambient atmospheric pressure, thereby enabling the pressure sensor 135 to be sensitive to very small changes in pressure with respect to the said ambient atmospheric pressure. Preferably, the said microporous membrane 148 is chosen from the group consisting of hydrophobic or oleophobic membranes.

Also advantageously, the said microporous membrane 148 will include at least one layer of fibrous material made of expanded polytetrafluoroethylene.

Figure 8:
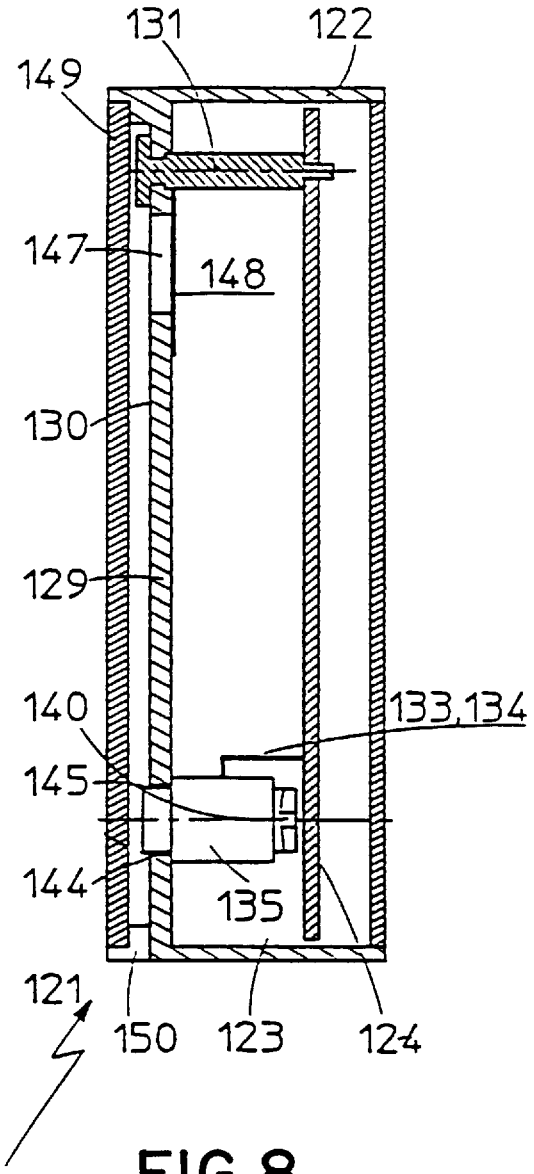
FIG. 8 is a section on A—A of the contactor shown in FIG. 7.

Thus constituted, the said immersion-sensitive wall 129 may form an outer face of the contactor 121; but according to a preferred embodiment of the invention, the immersion-sensitive wall 129 will be protected by an outer cover 149 provided with apertures 150 allowing a liquid to come into contact with the said wall. As shown in FIGS. 7 and 8, the apertures 150 will advantageously be side apertures so that the cover 149 can provide complete frontal protection of the wall 129.

According to a fourth characteristic of the invention, the electronic circuit 124 delivers a voltage to the said connection component 127, which is high enough to "switch it on" only if the resistance Re and the voltage Tp have respectively crossed their predetermined specific threshold. This double condition means that both the resistance across the electrodes 131 and 132 is sufficiently lowered by immersion of these electrodes in a predetermined liquid medium and the voltage Tp across the electrodes 133 and 134 is also sufficiently increased due to the effect of the pressure exerted on the pressure sensor 135.

Figure 10:
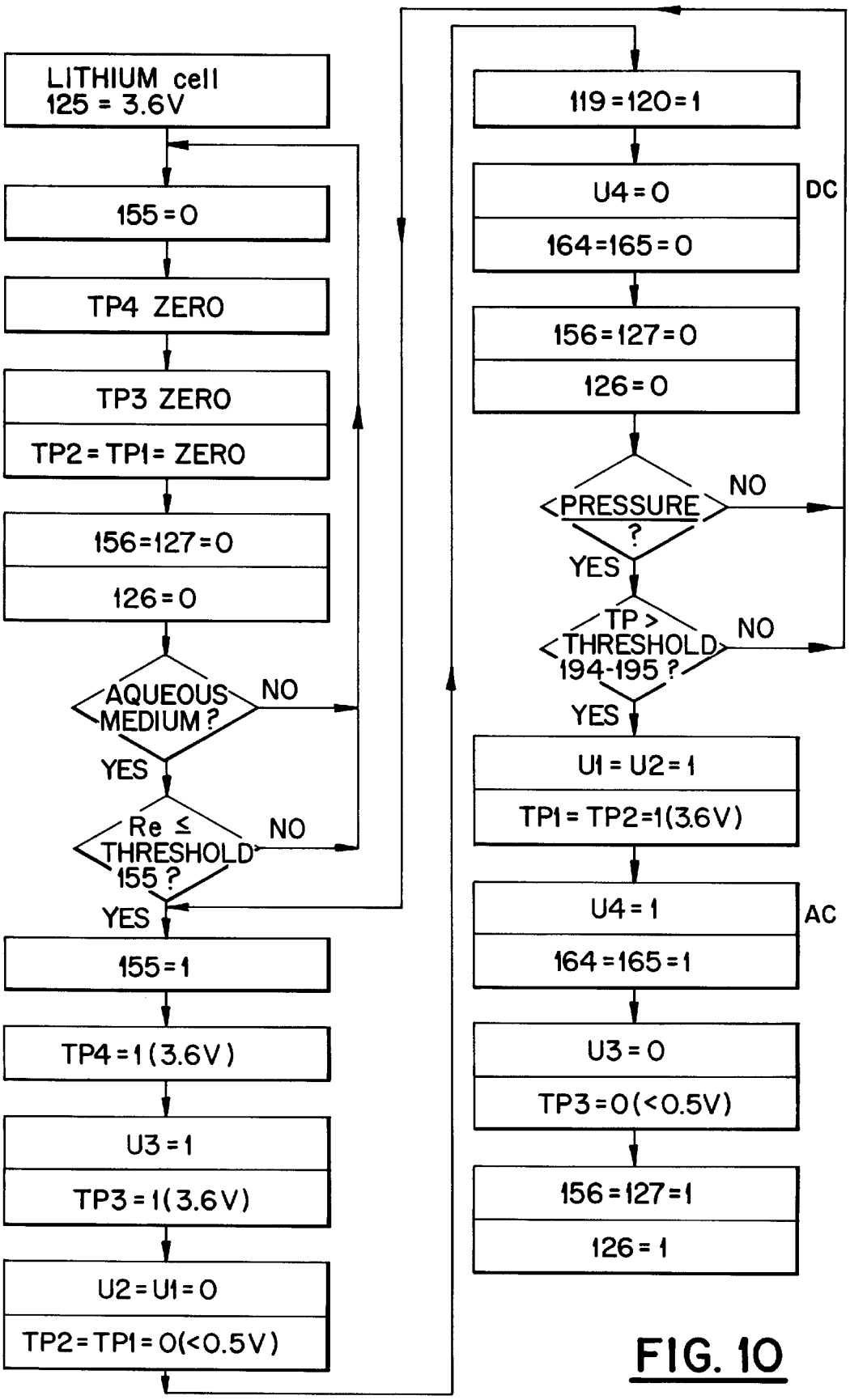
FIG. 10 is a logic flow diagram of the electronic circuit shown in FIG. 9.

The specific embodiment of this fourth characteristic will now be described, with reference more particularly to FIGS. 9 and 10.

FIG. 9 shows that the DC source 125 has a positive terminal 125*a* and a negative terminal 125*b* and that the power outlet 126 has a positive terminal 126*a* and a negative terminal 126*b*. The positive terminal 126*a* of the power outlet is connected directly to the positive terminal 125*a* of the DC source 125, while the negative terminal 126*b* of the outlet 126 is connected to the negative terminal 125*b* of the DC source 125 via a thyristor 127, the third terminal of which is connected to the electronic circuit 124 supplied with DC via the source 125, according to the information depicted in FIG. 9.

The thyristor 127 is protected against any overvoltages by two capacitors 152, 153 and by the resistor 154, these three being connected in parallel to the said thyristor 127.

The electronic circuit 124 comprises four independent modules: a power control H1, an oscillator H2, a signal detector H3 and a microphonic amplifier H4, these being fictitiously isolated in FIG. 9 by dotted-line perimeters. The modules H2, H3 and H4 can be supplied with voltage only if the electrical resistance apearing across the electrodes 131 and 132 has reached its threshold level, for example less than $10^4$ ohms.

The power control module H1, incorporating the first pair of electrodes 131 and 132, advantageously consists of

- two transistors 155, 156, the current gains of which are as high as possible, for example greater than 150;
- a thyristor 127 which withstands in the steady state a breakdown current greater than 3 A, this being specified for a voltage greater than 30 V, in such a way that this key element can never fail since, as stated above, the said thyristor 127 controls the outlet 126; and
- five capacitors 152, 153, 159, 157, 158 and five resistors 160, 162, 161, 163, 154, which are passive elements not having critical values outside their high reliability in all temperature circumstances under the normal operating conditions.

According to a preferred embodiment of the invention, the capacitors 152 and 153 and the resistor 154 enable the thyristor 127 to be protected against any inopportune overvoltages, especially the various times of energizing the circuit 124.

The oscillator module H2 advantageously consists of an operational amplifier U4, two diodes 164 and 165, two capacitors 166 and 167 and five resistors 168, 169, 170, 171, 172 so as to supply the said pressure sensor 135 with AC. The value needed to supply the pressure sensor 135, although not critical, requires a 2 V peak-to-peak AC voltage of 2 V for a frequency of 400 Hz, the said signal generated by the oscillator H2 being moderated in terms of power by the resistor 173 of the module H3.

The differential microphonic amplifier module H4 advantageously consists of two operational amplifiers U1, U2, ten resistors 190, 191, 192, 193, 194, 195, 196, 197, 198, 199 and four capacitors 115, 116, 117, 118 so as to detect an increasing AC voltage proportional to the pressure to which the sensor 135 is subjected. As the module H4 produces a differential gain considerably greater than 500, the resistor 194 allows this gain to be adjusted in the case of another instrumental application.

The signal detector module H3 advantageously consists of an operational amplifier U3, two diodes 119 and 120, the very low conduction thresholds of which are specific to detecting very small signals, two capacitors 151 and 104 and five resistors 100, 101, 173, 102, 103 so as to convert the amplified AC voltage of the said pressure sensor 135 into a DC voltage.

The operating logic of the contactor will now be described, referring more particularly to the diagram shown in FIG. 10 in which:

- Vcc represents the voltage supplied by the cell after the transistor 155 is turned on;
- TPn (TP1, TP2, . . . ) represents the measurable voltage at the corresponding control point;
- 0 represents the initial off state; and
- 1 represents the on state.

When the contactor 121 is not immersed, the electrical resistance Re is very high, or even infinite, and the transistor 155 remains in the 0 state, thus preventing the application of the voltage TP4 and likewise the application of voltage to the power outlet 126.

When the contactor 121 is immersed at a sufficient depth in the predetermined aqueous medium, the resistance Re appearing across the electrodes 131 and 132 goes below the $10^4$ ohm threshold value so that the 3.6 V (TP4-controllable) rated voltage is applied to the other three modules.

The pressure sensor 135 connected as a measurement bridge, supplied with the 400 Hz AC generated by the oscillator module H2, sends its signal to the high-gain (greater than 500) differential amplifier H4. This amplifier controls the diode detector H3 which converts the amplified AC voltage of the pressure sensor 135 into a DC voltage, this voltage being analysed by the comparator U3 which switches to the active state, this having the effect of actuating the transistor 156 and then the thyristor 127, thus closing the supply output 126.

At low pressure, the measurement bridge (sensor 135) is in virtual equilibrium so that the detection chain H4-H3 only analyses very small DC changes, and in this rest state the comparator U3 remains at a level 1 (TP3-controllable 3.6 V).

When the measurement bridge (sensor 135) is under pressure, the measurement chain H3-H4 detects an increasing (TP2-verifiable) AC voltage and when the threshold for actuating the comparator U3, predetermined by the resistors 194 and 195, is reached, this comparator switches to the 0 state (below the TP3-controllable 0.5 V), the transistor 156 and the thyristor 127 of the power module are then activated, thus energizing the power outlet 126.

The contactor 121 according to the invention thus has many options in terms of adjustment of the actuation thresholds:

i) by the selection of the current gain of the transistor 155, it is possible to determine the type of liquid medium capable of causing the contactor 121 to operate, thus making it possible to distinguish immersion in sea water from immersion in fresh water;

ii) by the choice of the resistors 194 and 195, it is possible to determine the minimum immersion depth capable of causing the contactor 121 to operate.

The invention also relates to the use of the contactors according to the invention in combination with a pyrotechnic device, and especially a pyrotechnic device designed to inflate inflatable reservoirs, by connecting the outlet to the pyrotechnic device.

Figure 11:
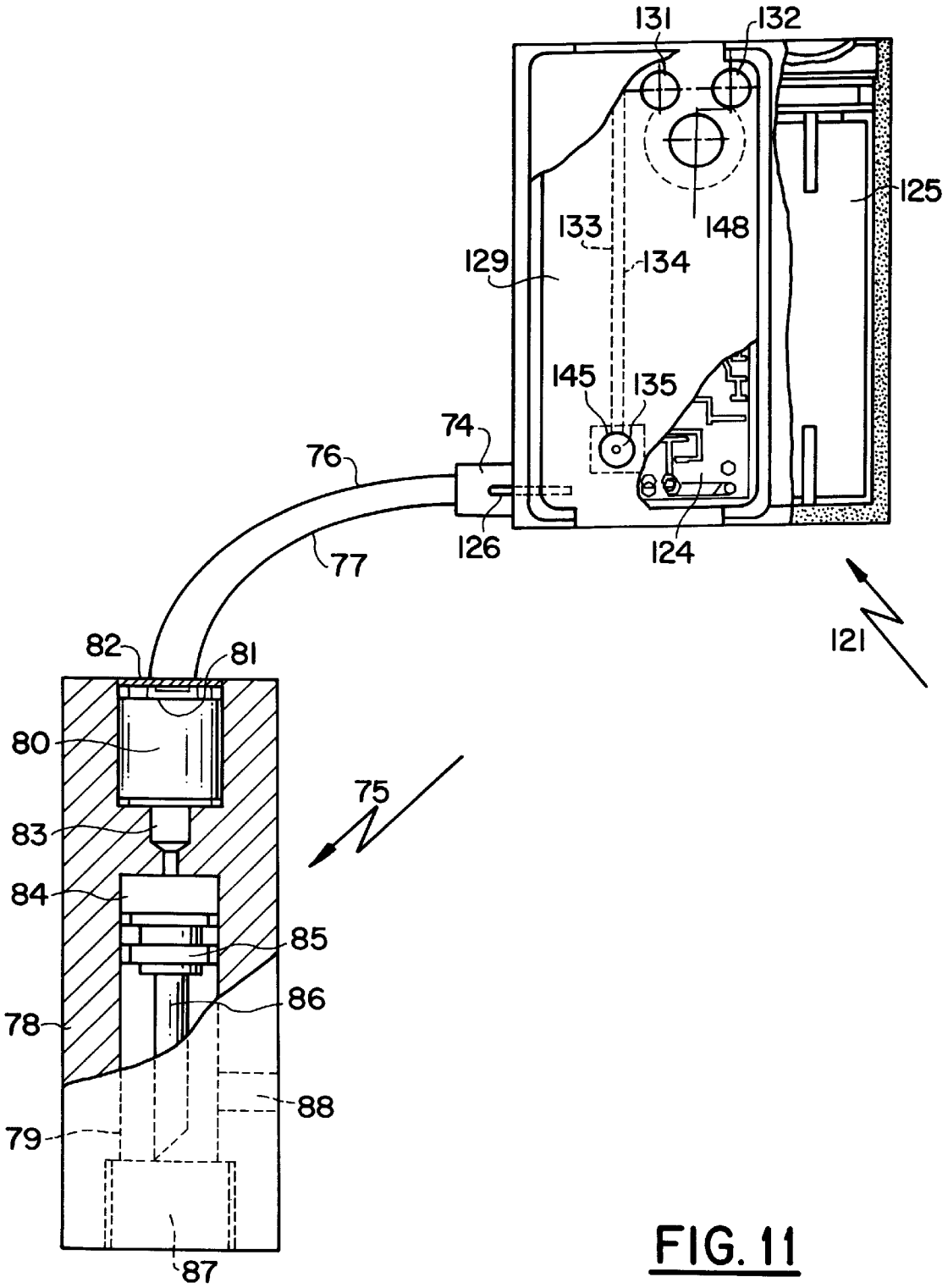
FIG. 11 is a simplified view, with partial cut-away, of a contactor according to the invention, connected to a pyrotechnic perforator.

FIG. 11 shows a contactor 121 according to the second preferred embodiment of the invention, the outlet 126 of which is connected to the connector 74 of a pyrotechnic perforator 75. The connector 74 is at least connected to the pyrotechnic perforator 75 via two conducting wires 76 and 77. The pyrotechnic perforator 75 consists of a cylindrical body 78 through which passes an axial bore 79 of varying diameter. At one end, this bore forms a combustion chamber containing a pyrotechnic charge 80 covered by an ignition bead 81 into which the wires 76 and 77 penetrate.

The combustion chamber is closed by a plug 82 and is extended by a nozzle 83 emerging in a working chamber 84 in which is housed a gas-tight piston 85 extended by a bevelled-cut hollow rod 86. The working chamber 84 terminates in a threaded hole 87 which is intended to receive a gas cartridge closed by a cap which is on the opposite side from the rod 86. A radial bore 88 brings the bottom part of the working chamber 84, in which the rod 86 moves, into communication with the outside. The hose for inflating the inflatable reservoir, for example the hose of the inflatable life-jacket, will be connected up to this bore.

When a person or an object equipped with an inflatable reservoir fitted with such a device on its lower part falls into the water and remains there for a certain time, the contactor 121 closes the electrical circuit and the current supplied by the cell 125 causes the ignition pill 81 to ignite, which in turn ignites the charge 80. The combustion gases pass through the nozzle 83 and enter the chamber 84, moving the piston 85 whose hollow rod 86 will tear the cap sealing the gas cartridge. The gas escaping from the cartridge will fill the bottom part of the chamber 84 and, via the bore 88, will inflate the inflatable reservoir

We claim:

1. Electrical contactor (21; 121) which can be actuated by immersion in a liquid medium and comprises a casing (22; 122) which includes a liquid-tight compartment (23; 123) which contains an electronic circuit (24; 124) interposed between a DC power source (25; 125) and a power outlet (26; 126), the said circuit comprising at least one connection component (27; 127) which connects the source (25; 125) to the outlet (26; 126) only if a sufficient voltage is applied to it, the said compartment (23; 123) having an immersion-sensitive wall (29; 129) with an external face (30; 130) which is in direct contact with the liquid in which the contactor (21; 121) is immersed, characterized in that:

i) the said electronic circuit (24; 124) includes a first pair of electrodes (31–32; 131–132), the free ends of which lie on the external face (30; 130) of the immersion wall (29; 129) and which thus constitute a variable resistor ($R_3$; Re) whose resistance depends on the nature of the medium with which the wall is in contact;

ii) the said electronic circuit (24; 124) includes a second pair of electrodes (33–34; 133–134). the free ends of which are connected to an element (35; 135) which is sensitive to the pressure applied to it and at least part of which lies on the external face (30; 130) of the said immersion wall (29; 129) so as to make the said electrodes sensitive to the pressure of the medium with which the said wall is in contact;

iii) the said immersion-sensitive wall (29; 129) includes an aperture (47; 147) closed by a microporous membrane (48; 148) which is permeable to gases and impermeable to the said liquid medium;

iv) the said electronic circuit (24; 124) delivers the sufficient voltage to the said connection component (27; 127) only if each pair of electrodes has identified an occurrence of a threshold, predetermined in respect of its operating parameters, being crossed.

2. Contactor according to claim 1, characterized in that the said connection component (27; 127) is chosen from the group consisting of semiconductors and relays.

3. Contactor according to claim 2, characterized in that:

the free ends of the second pair of electrodes (33–34) are connected to a force-sensitive resistor (35) arranged on the external face (30) of the said immersion wall (29) so as thus to constitute a variable resistor ($R_4$) whose resistance depends on the pressure of the medium with which the said wall is in contact;

and in that the said electronic circuit (24) delivers the sufficient voltage to the said connection component (27) only if the resistance of each of the two variable resistors ($R_3$, $R_4$) becomes less than a predetermined specific threshold resistance.

4. Contactor according to claim 3, characterized in that the said connection component (27) is a transistor.

5. Contactor according to claim 3, characterized in that the said electronic circuit (24) comprises two independent potentiomeLric divider bridges ($L_1$, $L_2$) connected to the said connection component (27) and each including an input comparator and an output comparator which are separated by a diode, each bridge containing one of the two variable resistors ($R_3$, $R_4$) which is associated with its threshold resistance constituted by the resistors (4.1+4.1', 4.2+4.2').

6. Contactor according to claim 5, characterized in that each divider bridge consists of a double power operational amplifier.

7. Contactor according to claim 3, characterized in that the said force resistor (35) includes an internal free volume (40) which communicates with the inside of the sealed compartment (23).

8. Contactor according to claim 5, characterized in that the said divider bridges ($L_1$, $L_2$) are connected to an integrator (71) which turns on the output comparators (53, 54) only if the two variable resistors ($R_3$, $R_4$) have fallen below their threshold value for a predetermined period of time.

9. Contactor according to claim 8, characterized in that the said integrator (71) consists of a resistor (72) and a capacitor (73).

10. Contactor according to claim 2, characterized in that:

the free ends of the second pair of electrodes (133–134) are connected to a pressure sensor (135), the sensitive part of which lies on the external face (130) of the immersion-sensitive wall (129), which pressure sensor mainly consists of two Wheatstone bridges which are connected to the said electronic circuit (124) and can be modulated as a function of the pressure exerted on the said sensitive part so as to generate, between the said electrodes, a voltage Tp which varies as a function of the pressure of the medium with which the said wall is in contact;

and in that the said electronic circuit (124) delivers the sufficient voltage to the said connection component (127) only if the first pair of electrodes (131–132) has identified an electrical resistance Re less than a predetermined threshold and if the second pair of electrodes (133–134) has identified a voltage Tp greater than a predetermined threshold.

11. Contactor according to claim 10, characterized in that the connection component (127) is a thyristor.

12. Contactor according to claim 11, characterized in that the electronic circuit (124) comprises four separate modules: a power control (H1), an oscillator (H2), a signal detector (H3) and a microphone amplifier (H4), it being possible for the power control, oscillator, signal detector and microphone amplifier modules to be supplied with voltage only if the electrical resistance appearing across the first pair of electrodes (131–132) has reached its threshold level.

13. Contactor according to claim 12, characterized in that the power control module (H1) integrating the first pair of electrodes (131 and 132) consists of: two transistors (155, 156), the thyristor (127), five capacitors (152, 153, 159, 157, 158) and five resistors (160, 162, 161, 163, 154).

14. Contactor according to claim 13, characterized in that the thyristor (127) is protected against any overvoltages by two capacitors (152, 153) and a resistor (154) which are connected to the said thyristor (127).

15. Contactor according to claim 12, characterized in that the oscillator module (H2) consists of an operational amplifier (U4), two diodes (164, 165), two capacitors (167, 166) and five resistors (168, 169, 170, 171, 172) so as to supply the said pressure sensor (135) with AC current.

16. Contactor according to claim 12, characterized in that the signal detector module (H3) consists of an operational amplifier (U3), two diodes (119, 120), two capacitors (151, 104) and five resistors (100, 101, 173, 102, 103) so as to convert the amplified AC voltage from the said pressure sensor (135) into a DC voltage.

17. Contactor according to claim 16, characterized in that the differential microphonic amplifier module (H4) consists of two operational amplifiers (U1, U2), ten resistors (190, 191, 192, 193, 194, 195, 196, 197, 198, 199), and four capacitors (115, 116, 117, 118) so as to amplify the voltage transmitted by the pressure sensor (135).

18. Contactor according to claim 14, characterized in that the said pressure sensor (135) includes an internal free volume (140) which communicates with the inside of the sealed compartment (123).

19. Contactor according to claim 1, characterized in that the said microporous membrane (48; 148) is chosen from the group consisting of hydrophobic membranes and oleophobic membranes.

20. Conductor according to claim 19, characterized in that the said membrane (48; 148) includes at least one layer of fibrous material made of expanded polytetrafluoroethylene.

21. Contactor according to claim 1, characterized in that the said casing (22; 122) includes a sealed housing (28; 128) for the DC source (25; 125).

22. Contactor according to claim 1, characterized in that the said immersion-sensitive wall (29; 129) is protected by an outer cover (49; 149) provided with apertures (50; 150) allowing a liquid to come into contact with the said wall.

23. A contactor according to any one of the preceding claims, characterized in that the power outlet (26, 126) is connected to a pyrotechnic device.

24. A contactor according to claim 23, characterized in that the pyrotechnic device is a pyrotechnic perforator (75) coupled to a pressurized-gas cartridge.

25. A contactor according to claim 23, characterized in that the pyrotechnic device is a pyrotechnic gas generator.

* * * * *